United States Patent [19]

Chan et al.

[11] Patent Number: 4,971,883

[45] Date of Patent: Nov. 20, 1990

[54] METAL ALKOXIDE MODIFIED RESINS FOR NEGATIVE-WORKING ELECTROSTATIC LIQUID DEVELOPERS

[75] Inventors: Dominic M. Chan, Wilmington; Torence J. Trout, Yorklyn, both of Del.

[73] Assignee: E. I. Du Pont de Nemours and Company, Wilmington, Del.

[21] Appl. No.: 412,327

[22] Filed: Sep. 25, 1989

[51] Int. Cl.[5] ..... G03G 11/00; G03G 9/12

[52] U.S. Cl. ..... 430/114; 430/137; 430/115

[58] Field of Search ..... 430/115, 137, 114

[56] References Cited

U.S. PATENT DOCUMENTS 4,144,184 3/1979 Takahata et al. ..... 252/62.1

*Primary Examiner*—J. David Welsh

[57] ABSTRACT

Negative-working electrostatic liquid developer consisting essentially of (A) nonpolar liquid having Kauri-butanol value less than 30, present in major amount, (B) particles, average by area particle size of less than 10 μm, of a polymer prepared from the reaction product of polymeric resin having free carboxyl groups and a metal alkoxide as defined, and (C) nonpolar liquid soluble ionic or zwitterionic charge director compound.

Optionally a colorant and an adjuvant compound are present. Process of preparation of electrostatic liquid developers is described. The developer is useful in copying, making proofs including digital color proofs, Lithographic printing plates, and resists.

62 Claims, No Drawings

METAL ALKOXIDE MODIFIED RESINS FOR NEGATIVE-WORKING ELECTROSTATIC LIQUID DEVELOPERS

TECHNICAL FIELD

This invention relates to an electrostatic liquid developer having improved properties. More particularly this invention relates to an electrostatic liquid developer containing particles of a metal alkoxide modified resin.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 $\mu$m average by area size as measured by a Horiba CAPA-500 centrifugal automatic particle analyzer. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably an adjuvant, e.g., polyhydroxy compound, aminoalcohol, polybutylene succinimide, an aromatic hydrocarbon, etc. to the liquid toner comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, and poor solid area coverage (density), and/or image squash. In order to overcome such problems much research effort has been expended to develop new type charge directors, modified resins and/or charging adjuvants for electrostatic liquid toners.

It has been found that the above disadvantages can be overcome and improved negative-working electrostatic liquid developers prepared containing a dispersant nonpolar liquid, ionic or zwitterionic charge director compound, a modified resin as described below, and preferably a colorant. The improved electrostatic liquid developer when used to develop an electrostatic image results in improved image quality, reduced squash, and improved solid area coverage independent of the pigment and charge director present.

DISCLOSURE OF THE INVENTION

In accordance with this invention there is provided a negative-working electrostatic liquid developer having improved charging characteristics consisting essentially of (A) a nonpolar liquid having a Kauri-butanol value of less than 30, present in a major amount, (B) particles of a polymer prepared from the reaction product of a polymeric resin having free carboxyl groups and a compound of formula:

$$M(OR)_n(O-\overset{\overset{\displaystyle O}{\|}}{C}-R^1)_m$$

where M is a polyvalent metal, n is an integer $\geqq 1$, m is an integer $\geqq 0$, n + m = valency of the metal, R and $R^1$ can be the same or different and each is alkyl, vinyl, aryl, substituted alkyl, substituted vinyl and substituted aryl, the resin particles having an average by area particle size of less than 10 $\mu$m, and (C) a nonpolar liquid soluble ionic or zwitterionic charge director compound.

In accordance with an embodiment of this invention there is provided a process for preparing a negative-working electrostatic liquid developer for electrostatic imaging comprising (A) dispersing at an elevated temperature in a vessel a metal alkoxide modified resin which is a polymer prepared from the reaction product of a polymeric resin having free carboxyl groups and a compound of formula:

$$M(OR)_n(O-\overset{\overset{\displaystyle O}{\|}}{C}-R^1)_m$$

where M is a polyvalent metal, n is an integer $\geqq 1$, m is an integer $\geqq 0$, n + m = valency of the metal, R and $R^1$ can be the same or different and each is alkyl, vinyl, aryl, substituted alkyl, substituted vinyl and substituted aryl, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average by area particle size of less than 10 $\mu$m from the particulate media, and (D) adding to the dispersion a nonpolar liquid soluble ionic or zwitterionic charge director compound.

In accordance with a further embodiment of this invention there is provided a process for the preparation of toner particles for negative-working electrostatic liquid developers comprising A. dispersing at an elevated temperature in a vessel a polymeric resin having free carboxyl groups and a compound of formula:

$$M(OR)_n(O-\overset{\overset{\displaystyle O}{\|}}{C}-R^1)_m$$

where

M is a polyvalent metal, n is an integer $\geqq 1$, m is an integer $\geqq 0$, n +m =valency of the metal, R and $R^1$ can be the same or different and each is alkyl, vinyl, aryl, substituted alkyl, substituted vinyl and substituted aryl, and, a nonpolar liquid having a Kauri-butanol value of less than 30, by means of moving particulate media whereby the moving particulate media creates shear and/or impact, while maintaining the temperature in the vessel at a temperature sufficient to plasticize and liquify the resin and below that at which the nonpolar liquid boils and the resin decomposes, B. cooling the dispersion in said vessel to permit precipitation of the resin out of the dispersant, the particulate media being maintained in continuous movement during and subsequent to cooling whereby toner particles having an average by area particle size of less than 10 μm and a plurality of fibers extending therefrom are formed, and C. separating the dispersion of toner particles from the particulate media.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as fine particle size oxides, adjuvant, e.g., polyhydroxy compound, aminoalcohol, polybutylene succinimide, aromatic hydrocarbon, etc.

Aminoalcohol means that there is both an amino functionality and hydroxyl functionality in one compound.

Conductivity is the conductivity of the developer measured in picomhos (pmho)/cm at 5 hertz and 5 volts.

The dispersant nonpolar liquids (A) are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C, Isopar ®-H between 176° C. and 191° C., Isopar ®-K between 177° C. and 197° C, Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ®12 | 69 | 204 |
| Norpar ®13 | 93 | 210 |
| Norpar ®15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C, and 80° C, respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of modified resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, e.g., pigment component, etc.

Useful thermoplastic polymer resins having free carboxyl groups include: copolymers of acrylic or methacrylic acid and at least one alkyl ester of acrylic or methacrylic acid wherein alkyl is 1-20 carbon atoms, copolymers of ethylene and an α,β-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0.1 to 20%), or blends thereof. Preferred copolymers are the copolymer of ethylene and an α,β-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C, respectively. Preferred resins include acrylic resins, such as methylmethacrylate (5090%)/methacrylic acid (0.1-20%)/ethyl hexyl acrylate (10–50%), the percentages being based on the total weight of resin.

Other resins that may be used in combination with the above identified thermoplastic resins having free carboxyl groups include: polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, DE, etc.

The thermoplastic resins having free carboxyl groups described above are reacted with metal alkoxides and may have dispersed therein a pigment. The reaction can take place during or prior to developer preparation. Metal alkoxides that are reacted with the thermoplastic polymeric resin are represented by the general formula:

$$M(OR)_n(O-\overset{O}{\overset{\|}{C}}-R^1)_m$$

where M is a polyvalent metal, e.g., $Al^{+3}$, $Ti^{+4}$, $Zn^{+2}$, $Mg^{+2}$, $Ba^{+2}$ and $Zr^{+4}$, n is an integer $\geqq 1$, m is an integer $\geqq 0$ and n + m = valency of the metal R and $R^1$ can be the same or different and are alkyl of 1–100, preferably 1–30, carbon atoms, vinyl, aryl of 6–30 carbon atoms, e.g., benzene, naphthalene, biphenyl, etc.; substituted alkyl of 1–100, preferably 1–30, carbon atoms, e.g., with halogen, e.g., Cl, Br, I; hydroxy, etc.; substituted vinyl, e.g., enolates of 1,3 diketones; and substituted aryl of 6–30 carbon atoms, e.g., halogen, e.g., Cl, Br, I; hydroxy, alkyl of 1 to 30 carbon atoms, alkoxy of 1 to 30 carbon atoms, etc. The metal alkoxide is present in the polymeric resin in an amount of 0.1 to 15% by weight based on the weight of resin.

Suitable metal alkoxides include aluminum acetylacetonate, magnesium ethoxide, titanium isopropoxide, aluminum isopropoxide, aluminum phenoxide, aluminum isopropoxidedistearate, aluminum di(isopropoxide)acetoacetic ester chelate; aluminum trimethoxide; aluminum t-butoxide; aluminum isobutoxide; aluminum mono-sec-butoxide diisopropoxide; aluminum trisec-butoxide; aluminum n-butoxide; aluminum di(secbutoxide)acetoacetic ester chelate; aluminum ethoxide; aluminum benzoylacetonate; titanium tetra acetyl acetonate; bis(triethanolamine)titanium diisopropoxide; tetraphenyl titanate; titanium methoxide; titanium isobutoxide; titanium stearylate; titanium ethoxide; tetra-sec-butyl titanate; titanium n-propoxide; titanium n-butoxide; tetra-(2-ethylhexyl)orthotitanate; tetraoctyl titanate; titanium (di-n-butoxide)bis(acetylacetonate); tert-butyltitanate; titanium cresylate; zirconium pentanedionate; zirconium n-butoxide; zirconium n-propoxide; zirconium pentyloxide; zinc acetylacetonate; magnesium acetylacetonate; magnesium methoxide; magnesium methyl carbonate; barium 2,4-pentanedionate, etc.

In addition, the resins have the following preferred characteristics:

1. Be able to disperse a colorant, e.g., pigment, etc.
2. Be substantially insoluble in the dispersant liquid at temperatures below 40° C, so that the resin will not dissolve or solvate in storage,
3. Be able to solvate at temperatures above 50° C.,
4. Be able to be ground to form particles between 0.1 μm and 5 μm, average by area size (preferred size), e.g., determined by Horiba CAPA-500 centrifugal automatic particle analyzer, manufactured by Horiba Instruments, Inc., Irvine, CA.; and between 1 μm and 15 μm, in diameter, e.g., determined by Malvern 3600E Particle sizer, manufactured by Malvern, Southborough, MA.,
5. Be able to form a particle size (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and, about 30 μm average particle size. e.g., determined by Malvern 3600E Particle Sizer as described below,
6. Be able to fuse at temperatures in excess of 70° C.

By solvation in 3. above, the resins forming the toner particles will become swollen, gelatinous or softened.

Suitable nonpolar liquid soluble ionic or zwitterionic charge director compounds (C), which are generally used in an amount of 0.25 to 1500 mg/g, preferably 2.5 to 400 mg/g developer solids, include: negative charge directors, e.g., lecithin, Basic Calcium Petronate ®, Basic Barium Petronate ® oil-soluble petroleum sulfonate, manufactured by Sonneborn Division of Witco Chemical Corp., New York, NY, alkyl succinimide (manufactured by Chevron Chemical Company of California), anionic glycerides such as Emphos ® D70-30C., Emphos ®F 27-85 and Emphos ® PS-222, which are sodium salts of phosphated mono- and diglycerides with unsaturated and saturated acid substituents, etc. Emphos is a registered trademark of Witco Chemical Corp., New York, NY.

As indicated above, colorants are dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments include:

PIGMENT LIST

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |

-continued

PIGMENT LIST

| Pigment Brand Name | Manufacturer | Colour Index Pigment |
|---|---|---|
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Blackness Index 153) |

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used instead of the colorant or in combination with the colorant. Metal particles may also be added.

Another additional component of the electrostatic liquid developer is an adjuvant selected from the group consisting of polyhydroxy compound which contains at least 2 hydroxy groups, aminoalcohol, polybutylene succinimide, and aromatic hydrocarbon having a Kauributanol value of greater than 30. The adjuvants are generally used in an amount of 1 to 1000 mg/g, preferably 1 to 200 mg/g developer solids. Examples of the various above-described adjuvants include:

polyhydroxy compound: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc. as described in Mitchell U.S. Pat. No. 4,734,352 aminoalcohol compounds: triisopropanolamine, triethanolamine, ethanolamine, 3-amino-1- propanol, o-aminophenol, 5-amino-1-pentanol, tetra(2-hydroxyethyl)ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc. as described in Mitchell U.S. Pat. No. 4,631,244.

The disclosures of the above-listed United States patents describing the adjuvants are incorporated herein by reference.

The particles in the electrostatic liquid developer have an average by area particle size of less than 10 μm as measured by the Horiba CAPA-500 centrifugal automatic particle analyzer described above, preferably the average by area particle size is less than 5 μm. The metal alkoxide modified resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The negative-working electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed at least one of thermoplastic polymeric resin having free carboxyl groups, metal alkoxide, and dispersant polar liquid described above. Generally the polymeric resin, metal alkoxide, dispersant nonpolar liquid and optional colorant are placed in the vessel prior to starting the dispersing step. Optionally the resin and metal alkoxide can be reacted in a suitable vessel and the metal alkoxide resin formed can be placed in the dispersing vessel. Optionally the colorant can be added after homogenizing the resin and the dispersant nonpolar liquid. Polar additive can also be present in the vessel, e.g., up to 100% based on the weight of liquid, including nonpolar liquid. The dispersing step is generally accomplished at elevated temperature, i.e., the temperature of ingredients in the vessel being sufficient to plasticize and liquefy the resin but being below that at which the dispersant nonpolar liquid or polar liquid, if present, degrades and the resin and/or colorant, if present, decomposes. When the metal alkoxide and the resin are reacted during the dispersion step a high enough temperature for the reaction is needed. A preferred temperature range is 80 to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar liquid present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass with or without the presence of additional liquid; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin solidifies or precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

Another instrument for measuring average particles sizes is a Malvern 3600E Particle Sizer manufactured by Malvern, Southborough, MA which uses laser diffraction light scattering of stirred samples to determine average particle sizes. Since these two instrument use different techniques to measure average particle size the readings differ. The following correlation of the average size of toner particles in micrometers (μm) for the two instruments is:

| Value Determined By Malvern 3600E Particle Sizer | Expected Range for Horiba CAPA-500 |
|---|---|
| 30 | 9.9 + 3.4 |
| 20 | 6.4 + 1.9 |
| 15 | 4.6 + 1.3 |
| 10 | 2.8 + 0.8 |
| 5 | 1.0 + 0.5 |
| 3 | 0.2 + 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 10 percent by weight, preferably 0.3 to 3.0, and more preferably 0.5 to 2 weight percent with respect to the dispersant nonpolar liquid. One or more nonpolar liquid soluble ionic or zwitterionic charge director compounds (C), of the type set out above, can be added to impart a negative charge. The addition may occur at any time during the process; preferably at the end of the process, e.g., after the particulate media, if used, are removed and the concentration of toner particles is accomplished. If a diluting dispersant nonpolar liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged. Preferably the adjuvant compound is added after the dispersing step.

Two other process embodiments for preparing the electrostatic liquid developer include:

(A) dispersing at a reactive temperature a metal alkoxide and a thermoplastic polymeric resin having free carboxyl groups in the absence of a dispersant nonpolar liquid having a Kauributanol value of less than 30 to form a solid mass, (B) shredding the solid mass, (C) grinding the shredded solid mass by means of particulate media in the presence of a liquid selected from the group consisting of a polar liquid having a Kauributanol value of at least 30, a nonpolar liquid having a Kauributanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid, and (F) adding to the dispersion a liquid soluble ionic or zwitterionic charge director compound; and (A) dispersing, e.g., optionally at elevated reactive temperature, a metal alkoxide and a thermoplastic polymeric resin having free carboxyl groups in the absence of a dispersant nonpolar liquid having a Kauributanol value of less than 30 to form a solid mass.

(B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic charge director compound.

Optionally at least one colorant as described above may be present in step (A) of the first above-described process and step (C) of the second above-described process.

A preferred mode of the invention is described in Example 3.

INDUSTRIAL APPLICABILITY

The electrostatic liquid developers of this invention demonstrate improved image quality, resolution, solid area coverage, and toning of fine details, evenness of toning, reduced squash independent of charge director and pigment present. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image. Other uses are envisioned for the the toner particles are applied to a latent electrostatic image. Other uses are envisioned for the electrostatic liquid developers include: digital color proofing, highlight color, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes by area were monitored and determined by a Horiba CAPA-500 centrifugal particle analyzer or a Malvern 3600E Particle Sizer as described above, the conductivity was measured in picomhos (pmhos)/cm at 5 hertz and low voltage, 5 volts, and the density was measured using a Macbeth densitometer model RD918. The resolution is expressed in the Examples in line pairs/mm (lp/mm). Aldrich refers to Aldrich Chemical Co., Milwaukee, WI. Alpha refers to Alpha Products, Morton Thiokol, Inc., Danvers, MA.

CONTROL 1

The following ingredients were placed in a Union Process 1S Attritor, Union Process Company, Akron, Ohio:

| Ingredient | Amount (g) |
|---|---|
| Copolymer of ethylene (89%) and methacrylic acid (11%) melt index at 190° C. is 100, Acid No. is 66. | 200 |
| Heucophthal Blue G XBT-583D Heubach, Inc., Newark, N.J. | 50 |
| Isopar ®-L, nonpolar liquid having a Kauri-butanol value of 27, Exxon Corporation | 1000 |

The ingredients were heated to 100° C. +/−10° C. and milled at a rotor speed of 230 rpm with 0.1875 inch (4.76 mm) diameter stainless steel balls for two hours. The attritor was cooled to 42° C. to 50° C. while the milling was continued, and then 700 grams of Isopar ®-L, nonpolar liquid having a Kauri-butanol value of 27, Exxon Corporation, were added. Milling was continued at a rotor speed of 330 rpm for 22 hours to obtain toner particles with an average size of 5.7 μm measured with a Malvern Particle size analyzer. The particulate media were removed and the dispersion of toner particles was then diluted to 2 percent solids with additional Isopar ®-L and charged with 90 mg of Basic Barium Petronate ® (Aldrich)/g of toner solids resulting in conductivity of 65 pmhos/cm. Image quality was determined using a Savin 870 copier at standard mode: Charging corona set at 6.8 Kv and transfer corona set at 8.0 Kv using carrier sheets such as Plainwell off-set enamel paper number 3 class a 60 lb. test. Image quality was poor with poor solid area coverage, 2-5 line pair/mm resolution, uneven copy, and high image squash. Results are shown in Table 1 below.

CONTROL 2

The toner was prepared as described in Control 1 with the following exceptions: no pigment was used. The toner was cold ground for 6 hours with a final Malvern average particle size of 9.0 μm. The toner was diluted to 2% solids with additional Isopar ®-L and charged with 40 mg Basic Barium Petronate ®/g of toner solids resulting in a conductivity of 29 pmhos/cm. Image quality was determined using a modified Savin 870 copier set up to evaluate negative toners. The copier was run with a standard image target and the following biases: development housing bias = +500v, and transfer corona = +6kV. Images showed poor image quality, with high squash, solid area flow, and 1-2 lp/mm resolution. Results are found in Table 1 below.

CONTROL 3

The following ingredients were placed in a Union Process IS Attritor, Union Process Company, Akron, Ohio:

| Ingredient | Amount (g) |
|---|---|
| Copolymer of ethylene (91%) and methacrylic acid (9%) melt index at 190° C. is 500, Acid No. is 54. | 200 |
| Quindo ® Red R6700 pigment, manufactured by Mobay Chemical Corp., Haledon, N.J. | 11.11 |
| Isopar ®-L, nonpolar liquid having a Kauri-butanol value of 27, Exxon Corporation | 1000 |

The ingredients were heated to 100° C. +/−10° C. and milled at a rotor speed of 230 rpm with 0.1875 inch (4.76 mm) diameter stainless steel balls for two hours. The attritor was cooled to room temperature while the milling was continued, and then 700 grams of Isopar ®-L, nonpolar liquid having a Kauri-butanol value of 27, Exxon Corporation, were added. Milling was continued at a rotor speed of 330 rpm for 19 hours to obtain toner particles with an average size of 6.1 μm measured with a Malvern Particle size analyzer. The particulate media were removed and the dispersion of toner particles was then diluted to 2 percent solids with additional Isopar ®-L and charged with 40 mg of Basic Barium Petronate ® (Aldrich)/g of toner solids resulting in conductivity of 32 pmhos/cm. Image quality was determined using a Savin 870 copier at standard mode: Charging corona set at 6.8 Kv and transfer corona set at 8.0 Kv using carrier sheets such as Plainwell off-set enamel paper number 3 class a 60 lb. test. Image quality was fair with fair solid area coverage, 9 lp/mm resolution, uneven copy, and high image squash. Results are shown in Table 1 below.

CONTROL 4

The toner was prepared as in Control 1 with the following exceptions: The toner was cold ground for 17 hours with a final Malvern average particle size of 6.4 μm. The toner was diluted to 2% solids with additional Isopar ®-L and charged with 40 mg lecithin/g of toner solids resulting in a conductivity of 70 pmhos/cm. Image quality was determined using a Savin 870 copier in a standard mode: Charging corona set a 6.8kV and transfer corona set a +8.0kV using carrier sheets such as Plainwell offset enamel paper number 3 class 60 lb. test. Image quality was very poor, with poor solid area coverage, 2-4 lp/mm resolution, uneven copy and image squash. Results are found in Table 1 below.

CONTROL 5

The toner was prepared as in Control 1 with the following exceptions: 200 g of a terpolymer of methyl methacrylate (67.3%), methacrylic acid (3.1%), and ethyl hexyl acrylate (29.6%) were used instead of the copolymer of ethylene (89%) and methacrylic acid (11%). The toner was cold ground for 23 hours with a final Malvern average particle size of 7.2 μm. The toner was diluted to 2% solids with additional Isopar ®-L and charged with 40 mg Basic Barium Petronate ®/g of toner solids resulting in a conductivity of 30 pmhos/cm. Image quality was determined using a Savin 870 copier in a standard mode: charging corona set a 6.8kV and transfer corona set a +8.0kV using carrier sheets such as Plainwell offset enamel paper number 3 class 60 lb. test. Image quality was very poor and the image was reversed indicating that the toner was positively charged. The image was characterized by poor solid area coverage, no lp/mm resolution, uneven copy, and high image squash. Results are found in Table 1 below.

EXAMPLE 1

The procedure of Control 1 was repeated with the following exceptions: 50.63 grams of Heucophthal Blue G XBT-583D were used instead of 50 grams. In addition 2.53 grams of aluminum acetylacetonate (Aldrich) were added at the beginning. The toner was cold ground for 16 hours with final Malvern average particle size of 5.7 μm. The toner was diluted to 2% solids with additional Isopar ®-L and charged with 90 mg Basic Barium Petronate ®/g of toner solids resulting in conductivity of 80 pmhos/cm. Image quality was determined using a Savin 870 copier in a standard mode: charging corona set at 6.8 kV and transfer corona set at +8.0 kV using carrier sheets such as Plainwell offset enamel paper number 3 class 60 lb test. Image quality was very good and substantially improved compared to Control 1 with very good solid area coverage, 10 line pair/mm resolution, very even copy, and very low image squash. Results are found in Table 1 below.

EXAMPLE 2

The following ingredients were placed in a Union Process 01 Attritor, Union Process Company, Akron, Ohio:

| Ingredient | Amount (g) |
|---|---|
| Copolymer of ethylene (89%) | 35 |

-continued

| Ingredient | Amount (g) |
|---|---|
| and methacrylic acid (11%) melt index at 190° C. is 100, Acid No. is 66. | |
| Heucophthal Blue G XBT-583D Heubach, Inc., Newark, N.J. | 8.97 |
| Isopar ®-L, nonpolar liquid having a Kauri-butanol value of 27, Exxon Corporation | 125 |
| Magnesium ethoxide (Alpha) | 0.90 |

The ingredients were heated to 100° C. +/−10° C. and milled with 0.1875 inch (4.76 mm) diameter stainless steel balls for two hours. The attritor was cooled to 42° C. to 50° C. while the milling was continued and then 125 grams of Isopar ®-H (Exxon) were added. Milling was continued for 23.5 hours and the average Malvern particle size was 5.1 μm. The particulate media were removed and the dispersion of toner particles was then diluted to 2% solids with additional Isopar ®-L and a charge director such as Basic Barium Petronate ® was added (90 mg Basic Barium Petronate ®/g of toner solids) resulting in conductivity of 105 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 lb test. Image quality was very good and substantially improved compared to Control 1 with good solid area coverage, 9 line pair/mm resolution, very even copy, and low image squash. Results are found in Table 1 below.

EXAMPLE 3

The procedure of Control 3 was repeated with the following exceptions: 11.37 grams of Quindo ® Red pigment R6700 pigment (Mobay) and 11.37 grams of Quindo ® Red R6713 pigment (Mobay) were used instead of the pigment used in Control 3. In addition 4.55 grams of titanium isopropoxide (Aldrich) were added prior to hot milling. The toner was cold ground for 16 hours with final Malvern average particle size of 4.9 μm. The toner was diluted to 2% solids with additional Isopar ®-L and charged with 40 mg Basic Barium Petronate ®/g of toner solids resulting in conductivity of 43 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 lb test. Image quality was very good and substantially improved compared to Control 3 with good solid area coverage, 11 line pair/mm resolution, very even copy, and very low image squash. Results are found in Table 1 below.

EXAMPLE 4

The procedure of Control 1 was repeated with the following exceptions: 51.28 grams of Heucophthal Blue G XBT-583D were used instead of 50 grams. In addition 5.13 grams of aluminum isopropoxide (Aldrich) were added at the beginning. The toner was cold ground for 16 hours with final Malvern average particle size of 5.8 μm. The toner was diluted to 2% solids with additional Isopar ®-L and charged with 40 mg lecithin/g of toner solids resulting in conductivity of 72 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 1b test. Image quality was very good and substantially improved compared to Control 4 with good solid area coverage, 8–9 line pair/mm resolution, very even copy, and very low image squash. Results are found in Table 1 below.

Example 5

The procedure of Example 2 was repeated with the following exceptions: no pigment was used and 0.71 gram of aluminum isopropoxide (Aldrich) was added prior to hot milling. The toner was cold ground for 38 hours with final Malvern average particle size of 9.5 μm. The toner was diluted to 2% solids with additional Isopar ®-L and charged with 40 mg Basic Barium Petronate ®/g of toner solids resulting in a conductivity of 58 pmhos/cm. Image quality was determined in using a Savin 870 copier in a standard mode: Charging corona set at 6.8 kV and transfer corona set at +8.0 kV using carrier sheets such as Plainwell offset enamel paper number 3 class 60 1b test. Image quality was very good and substantially improved compared to Control 2 with good solid area coverage, 8-9 line pair/mm resolution, very even copy, and very low image squash. Results are found in Table 1 below.

EXAMPLE 6

The procedure of Control 1 was repeated with the following exceptions: 51.28 grams of Heucophthal Blue G XBT-583D were used instead of 50 grams. In addition 5.13 grams of aluminum phenoxide (Alpha) were added prior to hot milling. The toner was cold ground for 17 hours with final Malvern average particle size of 5.5 μm. The toner was diluted to 2% solids with additional Isopar ®-L and charged with 90 mg Basic Barium Petronate ®/g of toner solids resulting in conductivity of 102 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 lb test. Image quality was very good and substantially improved compared to Control 1 with good solid area coverage, 11 line pair/mm resolution, very even copy, and very low image squash. Results are found in Table 1 below.

EXAMPLE 7

The procedure of Control 1 was repeated with the following exceptions: 165 grams of resin were used instead of 200 grams and 42.31 grams of Heucophthal Blue G XBT-583D were used instead of 50 grams. In addition 4.23 grams of aluminum isopropoxidedistearate were added prior to hot milling. The aluminum isopropoxidedistearate was synthesized by the following procedure:

A mixture of aluminum isopropoxide (Gold Label, Aldrich), (2.0 gm, 10 mmol) and stearic acid (Sigma Chem. Co., St. Louis, MO), (5.6 gm, 20 mmol) in 100 ml of toluene was heated in a 150° C. oil bath for 3 hours after which a total of 39 ml of liquid were distilled off between 80° C. to 110° C. The remaining solvent was removed in vacuum to give 6.0 gm (92 %) of the aluminum isopropoxidedistearate as a colorless glassy solid.

| Analysis: | % C | % H |
|---|---|---|
| Theory | 71.73 | 11.89 |
| Found | 70.03 | 11.33 |

850 grams of Isopar ®-L were added at the start of milling and an additional 550 grams were added prior to cold milling. The toner was cold ground for 17 hours with final Malvern average particle size of 5.7 μm. The toner was diluted to 2% solids with additional Isopar ®-L and charged with 90 mg Basic Barium Petronate ®/g of toner solids resulting in conductivity of 80 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 1b test. Image quality was very good and substantially improved compared to Control 1 with good solid area coverage, 11 line pair/mm resolution, very even copy, and very low image squash. Results are found in Table 1 below.

EXAMPLE 8

The procedure of Example 2 was repeated with the following exceptions: 35 grams of a terpolymer of methyl methacrylate (67.3%)/methacrylic acid (3.1%)/and ethyl hexyl acrylate (29.6%) were used instead of the copolymer of ethylene (89%) and methacrylic acid (11%) and 0.90 gram of aluminum isopropoxide (Aldrich) was used instead of magnesium ethoxide. The toner was cold ground for 16 hours with final Malvern average particle size of 4.1 μm. The toner was diluted to 2% solids with additional Isopar ®-L and charged with 40 mg Basic Barium Petronate ®/g of toner solids resulting in conductivity of 41 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 lb test. Image quality was fair and substantially improved compared to Control 5 with fair solid area coverage, 10 lp/mm resolution, and reduced image squash. Results are found in Table 1 below.

Example 9

The procedure of Example 2 was repeated with the following exceptions: 35 grams of a resin prepared as described below were used instead of the copolymer of ethylene (89%) and methacrylic acid (11%) and no magnesium ethoxide was added. To a hot solution of 50 gm of a copolymer of ethylene (89%) and methacrylic acid (11%) in 400 ml of toluene was added 1.0 gm of aluminum isopropoxidedistearate, prepared according to the previously described procedure. The resulting mixture was stirred in a 200° C. heating mantle for 2.5 hours and then cooled to room temperature. The reaction product was then filtered to collect the resin as a granular white solid (50 gm) after air-drying.

The toner was cold ground for 21.5 hours with final Malvern average particle size of 7.8 μm. The toner was diluted to 2% solids with additional Isopar ®-L and charged with 90 mg Basic Barium Petronate ®/g of toner solids resulting in conductivity of 50 pmhos/cm. Image quality was determined using a Savin 870 copier in a standard mode: Charging corona set at 6.8 kV and transfer corona set at +8.0 kV using carrier sheets such as Plainwell offset enamel paper number 3 class 60 lb.

test. Image quality was good and substantially improved compared to Control 1 with fair solid area coverage, 11 line pair/mm resolution, very even copy, and very low image squash. Results are found in Table 1 below.

TABLE 1

| CONTROL or EX | COND. pmhos/cm | IMAGE | lp/mm | Squash |
|---|---|---|---|---|
| C1 | 65 | V Poor | 2-5 | Poor |
| C2 | 29 | V Poor | 1-2 | V Poor |
| C3 | 32 | Fair | 9 | Poor |
| C4 | 70 | V Poor | 2-4 | Poor |
| C5 | 30 | V Poor | +Toner | V Poor |
| E1 | 80 | V Good | 10 | V Good |
| E2 | 105 | Good | 9 | Good |
| E3 | 43 | V Good | 11 | V Good |
| E4 | 72 | Good | 8-9 | V Good |
| E5 | 58 | V Good | 8-9 | V Good |
| E6 | 102 | Good | 11 | V Good |
| E7 | 80 | Good | 11 | V Good |
| E8 | 41 | Fair | 10 | Fair |
| E9 | 50 | Good | 11 | V Good |

We claim:

1. A negative-working electrostatic liquid developer having improved charging characteristics consisting essentially of (A) a nonpolar liquid having a Kauri-butanol value of less than 30, present in a major amount, (B) particles of a polymer prepared from the reaction product of a polymeric resin having free carboxyl groups and a compound of formula:

$$M(OR)_n(O-\overset{\overset{\displaystyle O}{\|}}{C}-R^1)_m$$

where

M is a polyvalent metal, n is an integer $\geqq 1$, m is an integer $\geqq 0$, n +m =valency of the metal, R and $R^1$ can be the same or different and each is alkyl, vinyl, aryl, substituted alkyl, substituted vinyl and substituted aryl, the resin particles having an average by areas particle size of less than 10 μm, and (C) a nonpolar liquid soluble ionic or zwitterionic charge director compound.

2. An electrostatic liquid developer according to claim 1 wherein R and $R^1$ are the same or different and are alkyl of 1 to 100 carbon atoms, substituted alkyl of to 100 carbon atoms, vinyl, substituted vinyl, aryl of to 30 carbon atoms and substituted aryl of 6 to 30 carbon atoms.

3. An electrostatic liquid developer according to claim 1 wherein aluminum acetylacetonate is reacted with the polymeric resin.

4. An electrostatic liquid developer according to claim 1 wherein magnesium ethoxide is reacted with the polymeric resin.

5. An electrostatic liquid developer according to claim 1 wherein titanium isopropoxide is reacted with the polymeric resin.

6. An electrostatic liquid developer according to claim 1 wherein aluminum isopropoxide is reacted with the polymeric resin.

7. An electrostatic liquid developer according to claim 1 wherein aluminum phenoxide is reacted with the polymeric resin.

8. An electrostatic liquid developer according to claim 1 wherein aluminum isopropoxidedistearate is reacted with the polymeric resin.

9. An electrostatic liquid developer according to claim 1 wherein the polymeric resin having free carboxyl groups is a copolymer of ethylene and α,β-ethylenically unsaturated acid selected from the group consisting of acrylic acid and methacrylic acid.

10. An electrostatic liquid developer according to claim 1 wherein the polymeric resin having free carboxyl groups is a copolymer of acrylic or methacrylic acid and at least one alkyl ester of acrylic or methacrylic acid wherein alkyl is 1 to 20 carbon atoms.

11. An electrostatic liquid developer according to claim 10 wherein the polymeric resin is a copolymer of methyl methacrylate (50-90%)/methacrylic acid (0.1-20%)/ethyl hexyl acrylate (10-50%).

12. An electrostatic liquid developer according to claim 11 wherein the polymeric resin is a copolymer of methyl methacrylate about 67%/methacrylic acid about 3%/ethyl hexyl acrylate about 30%.

13. An electrostatic liquid developer according to claim 2 wherein the polymeric resin having free carboxyl groups is a copolymer of ethylene (80 to 99.9%)/acrylic or methacrylic acid (20 to 0.1%)/alkyl ester of acrylic or methacrylic acid wherein alkyl is 1 to 5 carbon atoms (0 to 20%).

14. An electrostatic liquid developer according to claim 13 wherein the polymeric resin is a copolymer of ethylene (89%)/methacrylic acid (11%) having a melt index at 190° C. of 100.

15. An electrostatic liquid developer according to claim 2 wherein the resin particles have dispersed therein up to about 60% by weight of a colorant based on the total weight of developer solids.

16. An electrostatic liquid developer according to claim 15 wherein the colorant is a pigment.

17. An electrostatic liquid developer according to claim 15 wherein the colorant is a dye.

18. An electrostatic liquid developer according to claim 1 wherein a fine particle size oxide is present.

19. An electrostatic liquid developer according to claim 1 wherein an additional compound is present which is an adjuvant selected from the group consisting of polyhydroxy compound, aminoalcohol, polybutylene succinimide, and an aromatic hydrocarbon having a Kauributanol value of greater than 30.

20. An electrostatic liquid developer according to claim 15 wherein an additional compound is present which is an adjuvant selected from the group consisting of polyhydroxy compound, aminoalcohol, polybutylene succinimide, and an aromatic hydrocarbon having a Kauributanol value of greater than 30.

21. An electrostatic liquid developer according to claim 19 wherein a polyhydroxy adjuvant compound is present.

22. An electrostatic liquid developer according to claim 19 wherein an aminoalcohol adjuvant compound is present.

23. An electrostatic liquid developer according to claim 19 wherein a polybutylene succinimide adjuvant compound is present.

24. An electrostatic liquid developer according to claim 19 wherein an aromatic hydrocarbon adjuvant compound having a Kauri-butanol value of greater than 30 is present.

25. An electrostatic liquid developer according to claim 22 wherein the aminoalcohol adjuvant compound is triisopropanolamine.

26. An electrostatic liquid developer according to claim 1 wherein the particles have an average by area particle size of less than 5 μm.

27. An electrostatic liquid developer according to claim 1 wherein component (C) is an oil-soluble petroleum sulfonate.

28. An electrostatic liquid developer according to claim 1 wherein component (C) is a sodium salt of phosphated mono- and diglycerides with unsaturated or saturated acid substituents.

29. An electrostatic liquid developer according to claim 1 wherein component A is present in 85 to 99.9% by weight, based on the total weight of liquid developer, the total weight of developer solids is 0.1 to 15% by weight, and component (C) is present in an amount of 0.25 to 1,500 mg/g developer solids.

30. An electrostatic liquid developer according to claim 29 wherein the metal alkoxide is present in the polymeric resin in an amount of 0.1 to 15% by weight.

31. An electrostatic liquid developer according to claim 1 wherein the resin particles have a plurality of fibers integrally extending therefrom.

32. A process for preparing a negative-working electrostatic liquid developer for electrostatic imaging comprising (A) dispersing at an elevated temperature in a vessel a metal alkoxide modified resin which is a polymer prepared from the reaction product of a polymeric resin having free carboxyl groups and a compound of formula:

$$M(OR)_n(O-\overset{\overset{\displaystyle O}{\|}}{C}-R^1)_m$$

where

M is a polyvalent metal, n is an integer ≧ 1, m is an integer ≧ 0, n + m = valency of the metal, R and $R^1$ can be the same or different and each is alkyl, vinyl, aryl, substituted alkyl, substituted vinyl and substituted aryl, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average by area particle size of less than 10 μm from the particulate media, and (D) adding to the dispersion a nonpolar liquid soluble ionic or zwitterionic charge director compound.

33. A process according to claim 32 wherein the metal alkoxide, polymeric resin and nonpolar liquid are placed in the vessel prior to starting dispersing step (A) and the metal alkoxide modified resin is formed during step (A).

34. A process according to claim 32 wherein R and $R^1$ are the same or different and are alkyl of 1 to 100 carbon atoms, substituted alkyl of 1 to 100 carbon atoms, vinyl, substituted vinyl, aryl of 6 to 30 carbon atoms and substituted aryl of 6 to 30 carbon atoms.

35. A process according to claim 33 wherein the metal alkoxide compound is aluminum acetylacetonate.

36. A process according to claim 33 wherein the polymeric resin having free carboxyl groups is a copolymer of ethylene and α,β-ethylenically unsaturated acid selected from the group consisting of acrylic acid and methacrylic acid.

37. A process according to claim 33 wherein the polymeric resin having free carboxyl groups is a copolymer of acrylic or methacrylic acid and at least one alkyl ester of acrylic or methacrylic acid wherein alkyl is 1 to 20 carbon atoms.

38. A process according to claim 37 wherein the polymeric resin is a copolymer of methyl methacrylate (50–90%)/methacrylic acid (0–20%)/ethyl hexyl acrylate (10–50%).

39. A process according to claim 38 wherein the polymeric resin is a copolymer of methyl methacrylate about 67%/methacrylic acid about 3%/ethyl hexyl acrylate about 30%.

40. A process according to claim 33 wherein the polymeric resin having free carboxyl groups is a copolymer of ethylene (80 to 99.9%)/acrylic or methacrylic acid (20 to 0.1%)/alkyl ester of acrylic or methacrylic acid wherein alkyl is 1 to 5 carbon atoms (0 to 20%).

41. A process according to claim 40 wherein the polymeric resin is a copolymer of ethylene (89%)/methacrylic acid (11%) having a melt index at 190° C. of 100.

42. A process according to claim 32 wherein there is present in the vessel up to 100% by weight of a polar additive having a Kauri-butanol value of at least 30, the percentage based on the total weight of the liquid.

43. A process according to claim 33 wherein there is present in the vessel up to 100% by weight of a polar additive having a Kauri-butanol value of at least 30, the percentage based on the total weight of the liquid.

44. A process according to claim 42 wherein the particulate media are selected from the group consisting of stainless steel, carbon steel, ceramic, alumina, zirconia, silica and sillimanite.

45. A process according to claim 43 wherein the particulate media are selected from the group consisting of stainless steel, carbon steel, ceramic, alumina, zirconia, silica and sillimanite.

46. A process according to claim 32 wherein at least one colorant is present in dispersing step (A), and the temperature is maintained in the vessel at a temperature sufficient to plasticize and liquify the metal alkoxide modified resin and below that at which the dispersant nonpolar liquid degrades and the resin and colorant decomposes.

47. A process according to claim 33 wherein at least one colorant is present in dispersing step (A), and the temperature is maintained in the vessel at a temperature sufficient to cause reaction between the metal alkoxide and polymeric resin and to plasticize and liquify the reacted resin and below that at which the dispersant nonpolar liquid degrades and the reacted resin and colorant decomposes.

48. A process according to claim 32 wherein the charge director compound is an oil-soluble petroleum sulfonate.

49. A process according to claim 32 wherein the charge director is a sodium salt of phosphated mono- and diglycerides with unsaturated or saturated acid substituents.

50. A process according to claim 33 wherein the charge director compound is an oil-soluble petroleum sulfonate.

51. A process according to claim 33 wherein the charge director is a sodium salt of phosphated mono- and diglycerides with unsaturated or saturated acid substituents.

52. A process according to claim 32 wherein additional dispersant nonpolar liquid, polar liquid, or combinations thereof is present to reduce the concentration of toner particles to between 0.1 to 15 percent by weight with respect to the developer liquid.

53. A process according to claim 52 wherein the concentration of toner particles is reduced by additional dispersant nonpolar liquid.

54. A process according to claim 32 wherein cooling the dispersion is accomplished while grinding by means of particulate media to prevent the formation of a gel or solid mass with or without the presence of additional liquid.

55. A process according to claim 32 wherein cooling the dispersion is accomplished without stirring to form a gel or solid mass, followed by shredding the gel or solid mass and grinding by means of particulate media with or without the presence of additional liquid.

56. A process according to claim 32 wherein cooling the dispersion is accomplished with stirring to form a viscous mixture and grinding by means of particulate media with or without the presence of additional liquid.

57. A process according to claim 32 wherein an adjuvant compound selected from the group consisting of polyhydroxy compound aminoalcohol, polybutylene succinimide, and an aromatic hydrocarbon having a Kauributanol value of greater than 30 is added during the dispersing step (A).

58. A process for the preparation of toner particles for negative-working electrostatic liquid developers comprising A. dispersing at an elevated temperature in a vessel a polymeric resin having free carboxyl groups and a compound of formula:

$$M(OR)_n(O-\overset{\overset{\displaystyle O}{\|}}{C}-R^1)_m$$

where

M is a polyvalent metal, n is an integer $\geqq 1$, m is an integer $\geqq 0$, n + m = valency of the metal, R and $R^1$ can be the same or different and each is alkyl, vinyl, aryl, substituted alkyl, substituted vinyl and substituted aryl, and, a nonpolar liquid having a Kauri-butanol value of less than 30, by means of moving particulate media whereby the moving particulate media creates shear and/or impact, while maintaining the temperature in the vessel at a temperature sufficient to plasticize and liquify the resin and below that at which the nonpolar liquid boils and the resin decomposes, B. cooling the dispersion in said vessel to permit precipitation of the resin out of the dispersant, the particulate media being maintained in continuous movement during and subsequent to cooling whereby toner particles having an average by area particle size of less than 10 μm and a plurality of fibers extending therefrom are formed, and C. separating the dispersion of toner particles from the particulate media.

59. A process for preparing an electrostatic liquid developer comprising (A) dispersing at a reactive temperature a metal alkoxide and a thermoplastic polymeric resin having free carboxyl groups in the absence of a dispersant nonpolar liquid having a Kauributanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauributanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid, and (F) adding to the dispersion a liquid soluble ionic or zwitterionic charge director compound.

60. A process according to claim 59 wherein a colorant is present in step (A).

61. A process for preparing an electrostatic liquid developer comprising (A) dispersing a metal alkoxide and a thermoplastic polymeric resin having free carboxyl groups in the absence of a dispersant nonpolar liquid having a Kauri-butanol value of less than 30 to form a solid mass.

(B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic charge director compound.

62. A process according to claim 61 wherein at least one colorant is present in step (C), and the temperature is maintained in the vessel at a temperature sufficient to plasticize and liquify the modified resin and below that at which the dispersant nonpolar liquid degrades and the modified resin and colorant decomposes.

* * * * *